US008360287B2

(12) United States Patent
Ciavarella et al.

(10) Patent No.: US 8,360,287 B2
(45) Date of Patent: Jan. 29, 2013

(54) AIR PISTON AND DOME FOAM PUMP

(75) Inventors: Nick E. Ciavarella, Seven Hills, OH (US); Daniel M. Willis, Clinton, OH (US)

(73) Assignee: GOJO Industries, Inc., Akron, OH (US)

( * ) Notice: Subject to any disclaimer, the term of this patent is extended or adjusted under 35 U.S.C. 154(b) by 492 days.

(21) Appl. No.: 12/473,793

(22) Filed: May 28, 2009

(65) Prior Publication Data

US 2009/0294477 A1 Dec. 3, 2009

Related U.S. Application Data

(60) Provisional application No. 61/130,118, filed on May 28, 2008.

(51) Int. Cl.
*B67D 7/58* (2010.01)

(52) U.S. Cl. ..... 222/372; 222/209; 222/213; 222/214; 222/373; 222/494; 417/439; 417/480; 417/472; 239/330; 239/338

(58) Field of Classification Search ..... 222/190, 222/207, 209, 212–215, 372, 373, 490, 491, 222/494; 239/329–331, 338, 343; 417/199.1, 417/439, 480, 569, 571, 472, 478
See application file for complete search history.

(56) References Cited

U.S. PATENT DOCUMENTS

| | | | | |
|---|---|---|---|---|
| 2,465,274 | A * | 3/1949 | Rudd | 239/330 |
| 3,162,333 | A * | 12/1964 | Davidson | 222/207 |
| 4,220,264 | A | 9/1980 | Gamadia | |
| 4,330,071 | A * | 5/1982 | Ohlson | 222/207 |
| 4,420,098 | A | 12/1983 | Bennett | |
| 4,880,161 | A * | 11/1989 | Wright | 239/330 |
| 5,176,510 | A * | 1/1993 | Nilsson | 417/479 |
| 5,427,279 | A | 6/1995 | Kaufman | |
| 5,439,140 | A | 8/1995 | Meyer | |
| 5,462,208 | A | 10/1995 | Stahley et al. | |
| 5,505,341 | A * | 4/1996 | Gueret | 222/207 |
| 5,544,788 | A | 8/1996 | Meyer | |
| 5,984,146 | A | 11/1999 | Kaufman | |
| 6,409,050 | B1 | 6/2002 | Ophardt et al. | |

(Continued)

FOREIGN PATENT DOCUMENTS

| | | |
|---|---|---|
| EP | 1199105 | 4/2002 |
| EP | 1266696 | 12/2002 |

OTHER PUBLICATIONS

European Search Report, EP Application No. 09 16 1413, Sep. 11, 2009.

*Primary Examiner* — Jason Boeckmann
(74) *Attorney, Agent, or Firm* — Calfee, Halter & Griswold LLP

(57) ABSTRACT

A foam pump for pumping a foamable liquid from a foamable liquid source includes a premix chamber having an interior volume receiving the foamable liquid from the foamable liquid source. The foam pump also include a premix chamber air inlet valve, and a collapsible air chamber surrounds the premix chamber and fluidly communicates with the interior volume of the premix chamber through said premix chamber air inlet valve. The collapsible air chamber has an expanded volume and a compressed volume, and, when the collapsible air chamber is moved from its expanded volume to its compressed volume, air within the collapsible air chamber is forced into the premix chamber through the premix chamber air inlet valve and mixes with the foamable liquid received in the premix chamber. An outlet communicates with the premix chamber and, upon compression of the collapsible air chamber from its expanded volume to its compressed volume, foamable liquid and air are advanced from the premix chamber into the outlet. This foamable liquid and air mixture is homogenized into a foam product by advancement through a mesh screen.

20 Claims, 2 Drawing Sheets

U.S. PATENT DOCUMENTS

| | | | | |
|---|---|---|---|---|
| 6,601,736 | B2 | 8/2003 | Ophardt et al. | |
| 6,619,512 | B1 * | 9/2003 | Sayers et al. | 222/207 |
| 7,246,723 | B2 | 7/2007 | Santagiuliana | |
| 7,303,099 | B2 | 12/2007 | Ophardt | |
| 7,708,166 | B2 | 5/2010 | Ophardt | |
| 7,806,301 | B1 * | 10/2010 | Ciavarella et al. | 222/207 |
| 7,931,173 | B2 | 4/2011 | Yuan | |
| 2005/0257837 | A1 * | 11/2005 | Bailey | 137/512.15 |

* cited by examiner

AIR PISTON AND DOME FOAM PUMP

PRIORITY STATEMENT

This application gains the benefit of U.S. Provisional Application No. 61/130,118 filed May 28, 2008, which is incorporated herein by reference.

TECHNICAL FIELD

The invention herein resides in the art of foam pumps, wherein a foamable liquid and air are combined to dispense a foam product. Particularly, the invention relates to a pump wherein a premix chamber communicates with a source of foamable liquid, and a collapsible air chamber surrounds the premix chamber and communicates with the premix chamber through a valve, such that compression of the collapsible air chamber forces air into the premix chamber to mix with foamable liquid therein.

BACKGROUND OF THE INVENTION

For many years, it has been known to dispense liquids, such as soaps, sanitizers, cleansers, disinfectants, and the like from a dispenser housing maintaining a refill unit that holds the liquid and provides the pump mechanisms for dispensing the liquid. The pump mechanism employed with such dispensers has typically been a liquid pump, simply emitting a predetermined quantity of the liquid upon movement of an actuator. Recently, for purposes of effectiveness and economy, it has become desirable to dispense the liquids in the form of foam, generated by the interjection of air into the liquid. Accordingly, the standard liquid pump has given way to a foam generating pump, which necessarily requires means for combining the air and liquid in such a manner as to generate the desired foam.

Typically, foam pumps include an air pump portion and a fluid pump portion—the two requiring communication to ultimately create the foam. Such pumps have been provided through various types of pump structures, as known by those familiar with the foam pump arts. In the prior art pumps, the fluid and air are often advanced through separate pathways that join adjacent a screen element, such that the separate air and fluid paths are brought together and then forced through the screen to create bubbles of air in the fluid, thus creating the foam. Generally, richer, higher quality foams are a result of having smaller bubbles with a more uniformly distribution of bubble sizes. This invention provides a particularly compact foam pump of a structure heretofore unknown in the art. This invention also provides a high quality foam with small and uniformly sized bubbles of air.

SUMMARY OF THE INVENTION

This invention provides a foam pump for pumping a foamable liquid from a foamable liquid source. The foam pump includes a premix chamber having an interior volume receiving the foamable liquid from the foamable liquid source. The foam pump also includes a premix chamber air inlet valve, and a collapsible air chamber that surrounds the premix chamber and fluidly communicates with the interior volume of the premix chamber through a premix chamber air inlet valve. The collapsible air chamber has an expanded volume and a compressed volume, and, when the collapsible air chamber is moved from its expanded volume to its compressed volume, air within the collapsible air chamber is forced into the premix chamber through the premix chamber air inlet valve and mixes with the foamable liquid received in the premix chamber. An outlet communicates with the premix chamber and, upon compression of the collapsible air chamber from its expanded volume to its compressed volume, foamable liquid and air are advanced from the premix chamber into the outlet.

In particular embodiments, a mesh screen is provided in the outlet to create a foam product from the foamable liquid and air advanced therethrough. In other embodiments, the premix chamber is formed from a resilient dome secured to a base. In other embodiments, the collapsible air chamber is formed from a bellows body surrounding the premix chamber.

DESCRIPTION OF PARTICULAR EMBODIMENTS

Figure 1:
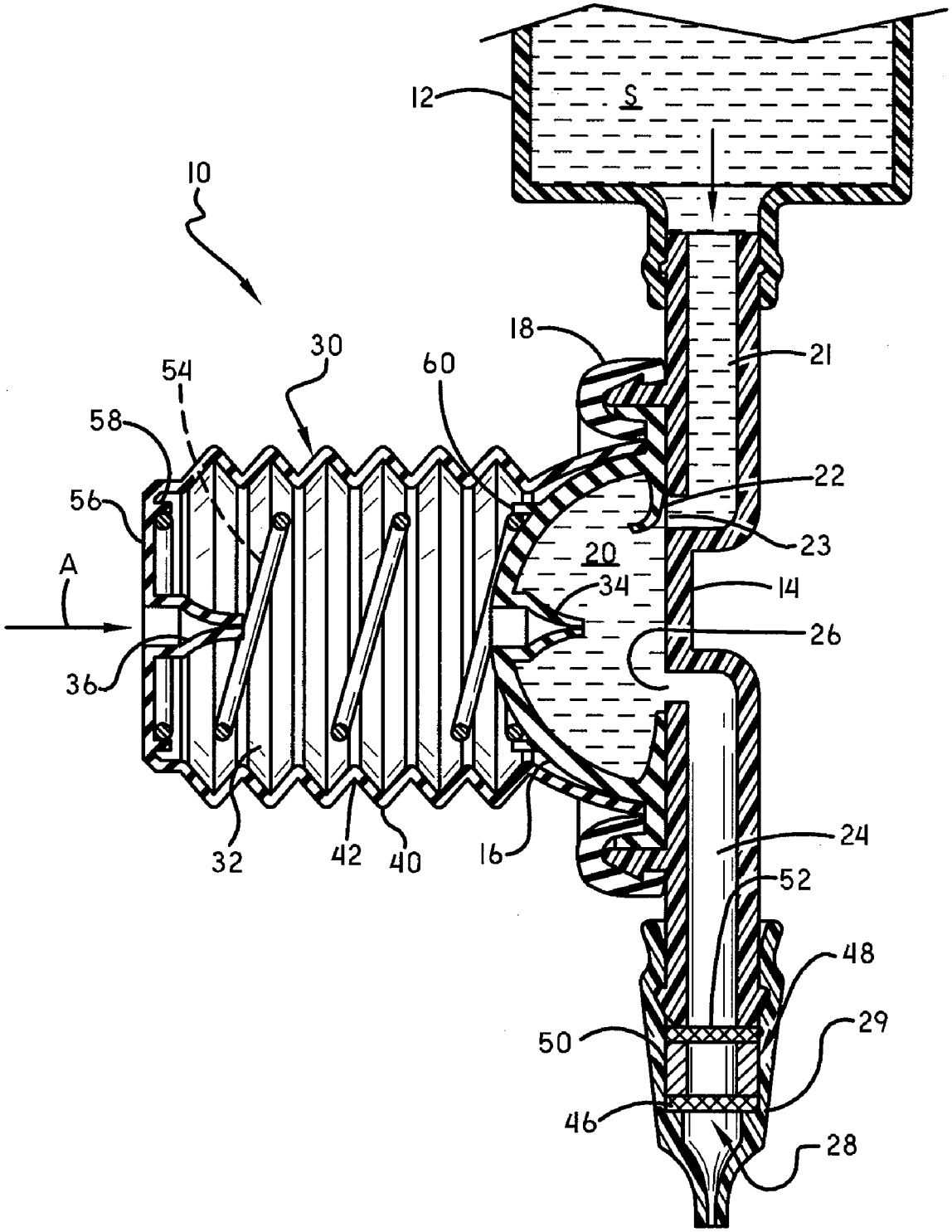
FIG. 1 is a side cross section view of an embodiment of a foam pump in accordance with this invention, shown associated with a foamable liquid source and shown unactuated.

In FIG. 1, the foam pump of this invention is shown and designated by the numeral 10. The foam pump 10 is intended to communicate with a source of foamable liquid in any suitable way, though it is here shown secured to and fluidly communicating with a container 12, which contains a foamable liquid S. It should be generally appreciated that this container 12 and pump 10 combination can serve as a refill unit for a dispenser housing that provides actuation mechanisms for actuating the pump 10. The container 12 can be a vented rigid structure (to permit air to flow in as foamable liquid S is removed) or can be a collapsible structure, as is known in the art.

The pump 10 includes a base 14, and a premix chamber dome 16 that is secured to the base 14 by a retaining ring 18 to define a premix chamber 20. The premix chamber dome 16 is made of a resilient material, such as an elastomer, so that it is capable of collapsing toward the base 14 upon the application of pressure, and thereafter expanding back to the dome shape of FIG. 1, as a result of the material resiliency. Alternatively, the premix chamber dome 16 can be spring biased to return to the dome shape of FIG. 1. The premix chamber 20 communicates with a source of foamable liquid (herein container 12 containing a foamable liquid S) through an inlet passage 21 in the base 14. An inlet valve 22 is provided to help regulate the flow of foamable liquid S into and out of the premix chamber 20. In this embodiment, the inlet valve 22 is shown as a resilient flap integral with and extending from the premix chamber dome 16 to cover the exit 23 from the inlet passage 21. Other valves may also be employed.

The premix chamber 20 also communicates with an outlet passage 24 in the base 14, through an entrance 26 thereto. This entrance may include any suitable one-way valve to permit flow out of the chamber and prevent flow back into the chamber. Alternatively, the entrance 26 may have no valve, as in the embodiment shown, wherein the valve is placed instead at an outlet of the base 14. More particularly, the outlet passage 24 extends to a dispensing tip 28, which is covered by an outlet valve 29 to regulate the flow of the foam product exiting the tip 28. The outlet valve 29 is shown here as a duckbill valve, but other suitable valves can be employed. As their names imply, the inlet valve 22 permits fluid to flow from the source of foamable liquid, through the inlet passage 21, and into the premix chamber 20, while prohibiting flow in the opposite direction, and the outlet valve 29 permits fluid to flow from inside the outlet passage 24 through the tip 28 and outlet valve 29, while prohibiting flow back into the outlet passage 24. It should further be appreciated that the outlet passage 24 could also be extended beyond the base 14 by communicating with a long dispensing tube, and the outlet valve 29 could be placed at the end of such a tube, rather than at the end of the base 14.

A bellows body 30 is secured to base 14 to enclose the premix chamber dome 16 within the volume defined between the base 14 and the bellows body 30. This volume is partially filled by premix chamber 20, with the volume between the premix chamber dome 16 and the bellows body 30 being designated as a collapsible air chamber 32. The collapsible air chamber 32 fluidly communicates with the premix chamber 20 through a premix chamber air inlet valve 34, and can fluidly communicate with the external atmosphere through an air chamber inlet valve 36. As its name implies, the air chamber inlet valve 36 permits the flow of air from the external atmosphere, through bellows body 30, and into the collapsible air chamber 32, while restricting flow in the opposite direction. In the particular embodiment shown here, the air chamber inlet valve 36 is a duckbill valve, but other valves could be employed.

Bellows body 30 is corrugated, with ridges 40 and valleys 42, and is made of a material that provides bellows body 30 with the ability to reversibly collapse and extend between a compressed volume and an expanded volume. The bellows body 30 is collapsible in the direction of arrow A to force the collapsible air chamber 32 to a compressed volume, and is preferably made of a material that is resilient enough to spring back to move the collapsible air chamber 32 to an expanded volume. The resiliency is not absolutely necessary, because a spring is also preferably employed, as noted below.

Figure 2:
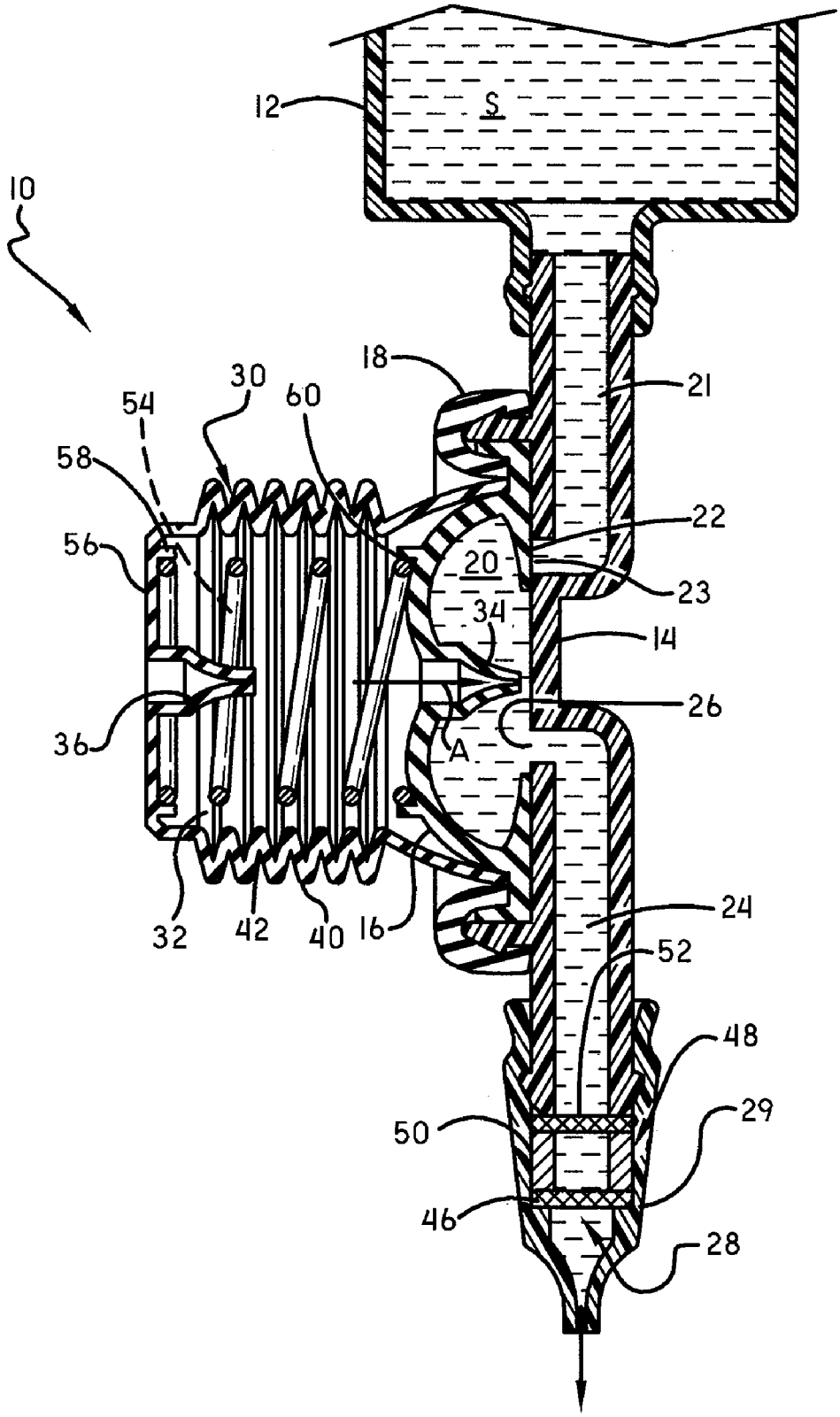
FIG. 2 is a side cross section view, as in FIG. 1, but shown actuated.

A spring 54 is positioned to extend between the end wall 56 of the bellows body 30 and the outer surface of the premix chamber dome 16. The spring 54 is shown in the figures as being retained by ribs 58, on the end wall 56, and ribs 60, on the premix chamber dome 16. Because the premix chamber dome 16 is resilient, the premix chamber 20 has a compressed volume and an expanded volume, and is moved to its compressed volume, under the influence of spring 54, as the bellows body 30 pressed in the direction of arrow A, urging the collapsible air chamber 32 toward its compressed volume. This is seen in FIG. 2. When the pressure is high enough in the collapsible air chamber 32, air is forced through the premix chamber air inlet valve 34 and into the premix chamber 20. The ease with which air is forced into the premix chamber 20 through the premix chamber air inlet valve 34 will depend upon the pressure necessary to open the valve. When the air inlet valve 34 opens, the air from collapsible air chamber 32 will enter the premix chamber 20 under pressure, and this will cause an initial coarse mixing of air and foamable liquid in the premix chamber 20.

Both the force of air being injected into the premix chamber 20 and the collapsing of the premix chamber dome 16 will force air and foamable liquid mixed within the premix chamber 20 to enter into the outlet passage 24 at the entrance 26. This coarse premixture will be forced along the outlet passage 24 and ultimately through at least one mesh screen 46, provided proximate the dispensing tip 28, to homogenize the mixture of air and foamable liquid and create a high quality foam product to be dispensed through the outlet valve 29. In particular embodiments, the mesh screen 46 can be provided as part of a mixing cartridge 48, which includes a hollow tube 50 mounted on both ends by mesh screens, here shown as an inlet mesh screen 52 and an outlet mesh screen 46. As the premix chamber dome 16 reverts back to its normal rest position, a vacuum will be created in the premix chamber 20 to draw an additional dose of fluid from the source of the foamable liquid through the inlet valve 22.

In a particular embodiment, inlet valve 22 is open when pump 10 is at rest, and only closes off the exit 23 of the inlet passage 21 when pressure is applied to the contents of the premix chamber 20. In this particular embodiment, employing a dome 16, inlet valve 22 will close upon application of force to collapse dome 16. Thus, when the dome 16 reverts to the rest position after being pressed toward base 14, the inlet valve 22 easily opens to permit foamable liquid S to enter the premix chamber 20. This also establishes the flow path of the liquid S as the path of least resistance, such that it is unlikely that air would be drawn through air inlet valve 34 upon the expansion of the dome 16. The flap shown for inlet valve 22 in the drawings, will work well for such and embodiment.

In general, the inlet valves 22 and air inlet valve 34 should be designed such that the inlet valve 22 opens more easily than does the air inlet valve 34 upon expansion of the dome 16. This will help ensure that the foamable liquid S fills the premix chamber 20 upon expansion of the dome 16. Similarly, the air chamber inlet valve 36 should not be so difficult to open that it prevents or hinders the expansion of the bellows body 30.

By providing the spring 54, the premix chamber dome 16 will begin to collapse immediately upon the application of force to the bellows body 30 in the direction of arrow A. Thus, the premix chamber 20 will collapse at least to some extent, regardless of only a small movement of the bellows body 30, and, upon release of the applied force, the premix chamber 20 will still function to pull liquid therein from the inlet passage 21. If the premix chamber 20 does not collapse, it will not expand upon a release of pressure, and will therefore not draw in new product from container 12. By providing the spring 54, the premix chamber 20 will collapse, at least a small amount, even upon short stroking the pump, where "short stroking" is understood as being a less than full compression of the bellows body 30 of the collapsible air chamber 32. In many pumps, short stroking leads to either complications in the functioning of the pump or a poor quality foam product or both.

The present pump provides what is termed herein a "two-stage" mixing function in that air is injected into the foamable liquid within the premix chamber 20 to create a coarse premix before reaching a mesh screen through which the premix is extruded. This is distinguishable from the known one-stage mixing, wherein the air and foamable liquid are first brought together at a mesh screen. The two-stage mixing practiced here provides a wetter and richer foam that has a smaller averaged bubble size and is very easy to spread. In a particular embodiment, the foamable liquid is a liquid soap, and the rich, wet and spreadable foam soap created by the present pump is very desirable.

In a particular embodiment, the foamable liquid S is a foamable soap, and, as compared to pumps of the prior art that employ single stage mixing, the pump of this invention provides a foam soap product with smaller average bubble size, and the ability to spread the foam soap (over the hands, for example) is optimized.

In light of the foregoing, it should be evident that the present invention provides a foam pump that substantially improves the art. In accordance with the patent statutes, only the preferred embodiments of the present invention have been described in detail hereinabove, but this invention is not to be limited thereto or thereby. Rather, the scope of the invention shall include all modifications and variations that fall within the scope of the attached claims.

The invention claimed is:

1. A foam pump for pumping a foamable liquid from a foamable liquid source, the foam pump comprising:

a compressible premix chamber having an interior volume for receiving the foamable liquid from the foamable liquid source;

a premix chamber air inlet valve for allowing air to pass into the premix chamber;

a collapsible air chamber surrounding said premix chamber air inlet valve and fluidly communicating with said interior volume of said premix chamber through said premix chamber air inlet valve, said collapsible air chamber having an expanded volume and a compressed volume, wherein, when said collapsible air chamber is moved from its expanded volume to its compressed volume, air within said collapsible air chamber is forced into said premix chamber through said premix chamber air inlet valve and mixes with the foamable liquid received in the premix chamber; and an outlet communicating with said premix chamber and receiving foamable liquid and air from said premix chamber upon compression of said collapsible air chamber from its expanded volume to its compressed volume.

2. The foam pump of claim 1, wherein said compressible premix chamber includes a dome secured to a base to define said interior volume of said compressible premix chamber between said base and said dome.

3. The foam pump of claim 2, wherein said premix chamber air inlet valve regulates the flow of air into said dome.

4. The foam pump of claim 3, wherein said premix chamber air inlet valve is a duckbill valve.

5. The foam pump of claim 3, wherein said dome is resilient so as to be compressible toward said base.

6. The foam pump of 5, wherein, as said collapsible air chamber is moved from its expanded volume toward its compressed volume, pressure is applied to said dome to cause said compressible premix chamber to move from an expanded volume toward a compressed volume.

7. A foam pump for pumping a foamable liquid from a foamable liquid source, the foam pump comprising:

a premix chamber having an interior volume for receiving the foamable liquid from the foamable liquid source;

a premix chamber air inlet valve;

a collapsible air chamber surrounding said premix chamber air inlet valve and fluidly communicating with said interior volume of said premix chamber through said premix chamber air inlet valve, said collapsible air chamber having an expanded volume and a compressed volume, wherein, when said collapsible air chamber is moved from its expanded volume to its compressed volume, air within said collapsible air chamber is forced into said premix chamber through said premix chamber air inlet valve and mixes with the foamable liquid received in the premix chamber;

an outlet communicating with said premix chamber and receiving foamable liquid and air from said premix chamber upon compression of said collapsible air chamber from its expanded volume to its compressed volume, wherein said premix chamber includes a dome secured to a base to define said interior volume of said premix chamber between said base and said dome;

wherein said premix chamber air inlet valve regulates the flow of air into said dome;

wherein said dome is resilient so as to be compressible toward said base;

wherein, as said collapsible air chamber is moved from its expanded volume toward its compressed volume, pressure is applied to said dome to cause said premix chamber to move from an expanded volume toward a compressed volume; and a spring extending between said premix chamber and said collapsible air chamber such that, as said collapsible air chamber is moved from its expanded volume toward its compressed volume, said spring presses against said dome to cause said premix chamber to move from an expanded volume toward a compressed volume.

8. The foam pump of claim 1, further comprising a liquid inlet valve regulating the flow of the foamable liquid into said compressible premix chamber from the foamable liquid source and preventing the flow of foamable liquid out of said premix chamber back toward the foamable liquid source.

9. The foam pump of claim 8, wherein said liquid inlet valve is open when the foam pump is at rest, and closes when pressure is applied to the contents of the compressible premix chamber.

10. A foam pump for pumping a foamable liquid from a foamable liquid source, the foam pump comprising:

a compressible premix chamber having an interior volume for receiving the foamable liquid from the foamable liquid source;

a premix chamber air inlet valve in fluid communication with the compressible premix chamber;

a collapsible air chamber in fluid communication with the premix chamber air inlet valve and fluidly communicating with the interior volume of the collapsible premix chamber through the premix chamber air inlet valve, the collapsible air chamber having an expanded volume and a compressed volume, wherein, when the collapsible air chamber is moved from its expanded volume to its compressed volume, air within the collapsible air chamber is forced into the premix chamber through the premix chamber air inlet valve and mixes with the foamable liquid received in the premix chamber;

an outlet communicating with the premix chamber and receiving foamable liquid and air from the premix chamber upon compression of the collapsible air chamber from its expanded volume to its compressed volume; and wherein compressing the collapsible air chamber compresses the collapsible premix chamber.

11. The foam pump of claim 10 wherein the collapsible premix chamber comprises a resilient dome.

12. The foam pump of claim 11 wherein the premix air inlet valve allows air to pass through the resilient dome into the premix chamber.

13. The foam pump of claim 10 wherein the collapsible air chamber surrounds the resilient dome.

14. The foam pump of claim 11 wherein the resilient dome includes a resilient member that prevents liquid from flowing from the collapsible premix chamber into a foamable liquid inlet passage.

15. The foam pump of claim 11 wherein the resilient dome includes an integrally formed premix air inlet valve and a resilient member that acts as a one-way check valve and allows liquid to enter the premix chamber but prevents liquid from flowing back into an inlet passage.

16. A foam pump comprising:

a liquid pump portion having a resilient dome;

an air inlet valve formed in the resilient dome;

a collapsible air chamber at least partially surrounding the resilient dome and in fluid communication with the air inlet valve;

a one way air intake valve in fluid communication with the collapsible air chamber;

wherein compressing the collapsible air chamber causes air to flow through the air inlet valve into the resilient dome;

wherein compressing the collapsible air chamber causes the resilient dome to move and reduce the volume of the reservoir defined at least partially within the resilient dome; and wherein the one way air intake valve allows air to enter the collapsible air chamber and the air inlet valve in the resilient dome prevents liquid from entering the collapsible air chamber.

17. The foam pump of claim 16 wherein the air inlet valve formed in the resilient dome is a duckbill valve.

18. The foam pump of claim 16 wherein the resilient dome comprises a resilient member that operates as a liquid inlet valve.

19. The foam pump of claim 16 further comprising an air inlet valve located through a wall of the collapsible air chamber.

20. The foam pump of claim 16 further comprising a mesh screen located downstream of the reservoir.

* * * * *